United States Patent [19]

Spoler

[11] 4,002,125

[45] Jan. 11, 1977

[54] MONORAIL SUPPORT

[75] Inventor: Johannes Gerhard Spoler, Hagen, Germany

[73] Assignee: DEMAG, A.G., Duisburg, Germany

[22] Filed: Sept. 29, 1975

[21] Appl. No.: 617,722

[30] Foreign Application Priority Data

Oct. 1, 1974 Germany ..... 2446770

[52] U.S. Cl. ..... 104/124; 14/1; 104/106; 104/118; 104/125

[51] Int. Cl.[2] ..... E01B 25/24; B61B 12/04

[58] Field of Search ..... 104/124, 123, 125, 89, 104/91, 94, 95, 106, 107, 118, 1 R; 308/2 R, 3 R; 16/87 R, 94 R, 96 R; 52/71; 14/1, 3, 13, 14, 15, 16 B, 17

[56] References Cited

UNITED STATES PATENTS

| | | | |
|---|---|---|---|
| 3,760,737 | 9/1973 | Becker et al. | 104/118 X |
| 3,842,462 | 10/1974 | Bainbridge | 16/87 X |
| 3,921,240 | 11/1975 | Fyfe | 308/2 R X |

FOREIGN PATENTS OR APPLICATIONS

| | | | |
|---|---|---|---|
| 1,021,874 | 1/1958 | Germany | 104/118 |

*Primary Examiner*—Robert J. Spar
*Assistant Examiner*—Randolph A. Reese
*Attorney, Agent, or Firm*—Mandeville and Schweitzer

[57] ABSTRACT

Apparatus is provided for supporting load bearing, sharply curved girders, particularly for use in a transportation system. The sharply curved girders are supported only at their ends, even for those of substantial length, so as to reduce the number of vertical supports for the girders. This is achieved by providing a relatively short cross-support for the girder extending from the vertical support through the girder at each end thereof, with that cross-support or console having one end bearing on the vertical support and the other end forming a portion of a pivot bearing positioned on the inside of the curve of the girder. A crossbeam rigidly connected to the vertical support also extends transversely of each girder end and forms the opposite portion of the pivot bearing. Thus, torsional forces tending to twist the outside of the curve of the girder downwardly under load is compensated by the pivot bearing which provides a twisting force in the opposite direction.

15 Claims, 6 Drawing Figures

MONORAIL SUPPORT

BACKGROUND OF THE INVENTION

The invention covers a support for a sharply curved girder forming part of a monorail structure for suspended and/or upright vehicles. Bent girders for upright monorail vehicles, as for example the Allweg train, are carried by a large number of supports directly bracing the girder from below which, with the exception of possible ground indentations, does not entail any particular static problems. The Allweg train is intended as a long distance transit system so that there was no particular requirement for harmonic environmental adaptation, which is a much more important consideration in city transit systems.

Bent girders forming part of a monorail system for suspended vehicles are known, for example, from the Wuppertal suspended train. The girders hang on portal-like supports arranged at short intervals. The supports, as well as the girder, affect the aesthetic appearance of the city to such an extent that this transit system although favorable from a technical point of view, has never been constructed elsewhere. Memorandum 444 of the Council for Steel Utilization, Dusseldorf, describes and pictures several steel highways bridging construction sites, plazas, railway tracks and the like. Here too, the pillars are arranged at relatively short intervals compared with the width of the street. In certain situations, the supports are arranged next to the roadway which is cantilevered from them. As these bridges are meant as interim constructions only, aesthetic appearance is not given much thought. Also known are light suspended rail installations in factories, which hang from the roof or from a special supporting frame. Such a suspended rail installation, however, when installed at a curve, is suspended at the connecting joints and in the curve itself, so that there is no danger of tilting of the monorail girder during changes in the load of the rail at the curve.

The above mentioned supports for straight and curved girders are not feasible for intercity transit systems with small upright and/or suspended cabins, where aesthetic appearance of the city is not to be disturbed by an unnecessary number of supports and long construction periods. In such heavily congested environments it is, therefore, thought essential to support relatively long girders of a monorail system at the connecting joints only to reduce the number of supports, and whereby the supports themselves are located relatively close to the rail path with due consideration for the necessary lateral distance required for the vehicles. Difficulties do arise, however, when a girder is in the form of a tight curve, particularly if the bend is so tight that the line of gravity of the girder passes outside the supports which are provided at the girder joints. In these cases, the girder develops a tilting moment, i.e. the center of the curve tries to swing down on the outside. This, of course, can be eliminated by providing an additional support at the center of the curve. This, however, cuts in half the distance between the supports, which is undesirable, and often not even possible in installations in congested areas.

STATEMENT OF THE INVENTION

It is the object of the invention to provide a support for a sharply curved monorail girder, i.e., a girder with its line of gravity located outside the curve and outside the supports at the ends thereof and of the greatest possible length, for suspended and/or upright vehicles without decreasing the distance between supports. This is solved by supporting the girder only at its ends on vertical supports. Included are transverse cross-supports or consoles which rest on the vertical supports at the curve exterior, which consoles form at the curve interior of the girder part of pivot bearings which are supported from below by transverse crossbeams attached to the vertical supports.

The consoles or cross-supports located at the end of two adjacent girders rest on one vertical support, which reduces the number of the latter. As the supports are to be as close as possible to the track for suspended vehicles, the consoles which are disposed at the curve exterior do not incorporate the line of gravity of the girder. Thus, there is a tilting moment in the girder under load which is absorbed by the pivot bearing which is located at the curve interior immediately adjacent the console. This arrangement eliminates tilting of a sharply curved girder by using supports with little transverse length. The supports are arranged close to the girder and do not affect the adjacent environment as much, because the vertical supports as well as the related crossbeams may be very slim due to the limited tilting moment.

The consoles or cross-supports are preferably arranged at the height of the horizontal longitudinal center axis of the girder, and with the heighth of the consoles, preferably, no more than 25% of the girder height. Such small thicknesses are sufficient to transmit support pressures as well as tilting moments caused by the curve in the girder, and they do not get in the way of suspended and upright vehicles.

As another aspect of the invention, the pivot bearings are arranged at the curve interior of the girder. For steel girders, the pivot bearings consist of the inner ends of the consoles or cross-supports which are preferably attached to the two vertical web plates of the box-shaped girder. The pivot bearings may also be screwed to the girder. The supports are provided with step bearings for supporting the consoles. The crossbeams of the supports are provided at the ends with bearing plates protruding over the pivot bearings attached to the girder so that support pressures as well as tilting moments may be transmitted from the girder via the consoles in conjunction with the crossbeams onto the supports.

According to the invention, the supports are situated between the ends of successive girders, so that the latter can easily be mounted. The rails (for the vehicles) attached to each girder are connected with the rails of the next girder whereby, as is conventional, adapters or transition pieces allow for lengthwise expansion of the girders. To facilitate such expansion, displacement bearings are also arranged between the consoles and step bearings as well as between the pivot bearings and bearing plates. As the box-shaped girder is under extreme torsional stress due to its curvature, it is provided with transverse braces, as will be appreciated. However, the braces may have cut-out clearances to permit inspection of the girder, and due to the slim construction of the girder, they are provided with reinforcements in the form of welded flat steels to compensate for the weakness of the beams caused by the clearances. Torque is particularly great at the girder ends, so that the cross braces are arranged at shorter intervals at the girder ends than at the girder center, where the distance measures about 1.5 times the girder height.

As a further aspect of the invention, the girder ends are equipped with stabilizing devices in the form of tabs and bolts. The stabilizing devices permit alignment of adjacent girder ends with each other, as well as change in the distance between the individual girders. Also, they eliminate lateral displacement if changes in girder length due to differential heat expansion lead to lateral displacement of the girders versus supports and/or bearings.

As purely illustrative of apparatus for carrying out the invention, one may note the attached drawings, showing the interconnection of several girders forming the support for the rails of a monorail system.

DETAILED DESCRIPTION OF THE INVENTION

Figure 1:
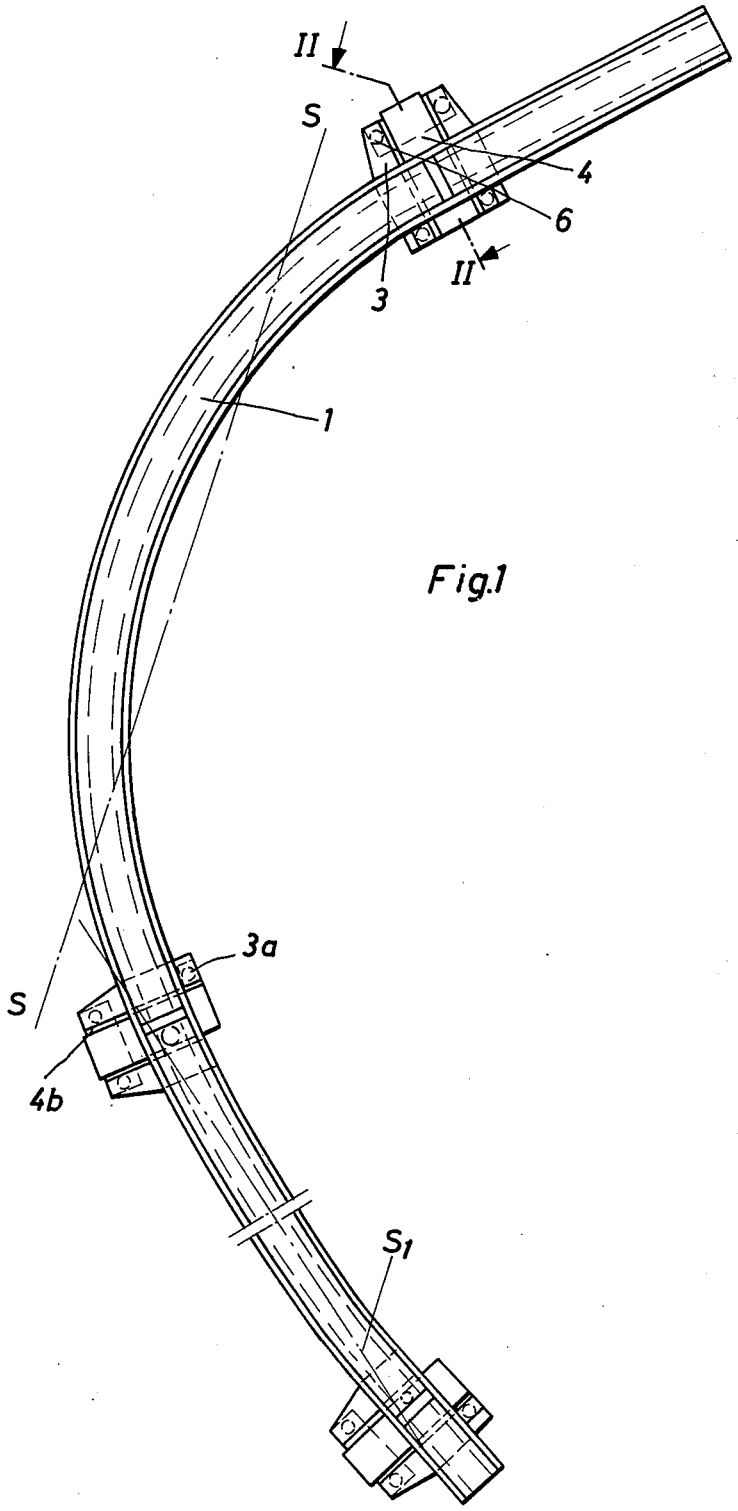
FIG. 1 is a top plan view of several monorail girders, interconnected together with supports embodying the invention, with one girder forming a sharp curve.

Referring to the drawings in which like references refer to like parts throughout the several views thereof, FIG. 1 shows a rail installation section with two differentially curved girders which are followed by straight girders. As can be seen, the latter are at an angle of about 90° to each other. At the ends of girder 1 with the sharp curve, line of gravity S passes outside support 4. The type of support which is the subject of this invention, covers only this type of sharply curved girder where there is danger of tilting of the girder due to lifting off the interior bearings. It does not refer to a gently curved girder where line of gravity $S_1$ (FIG. 1) passes through the supports and girder ends.

Figure 2:
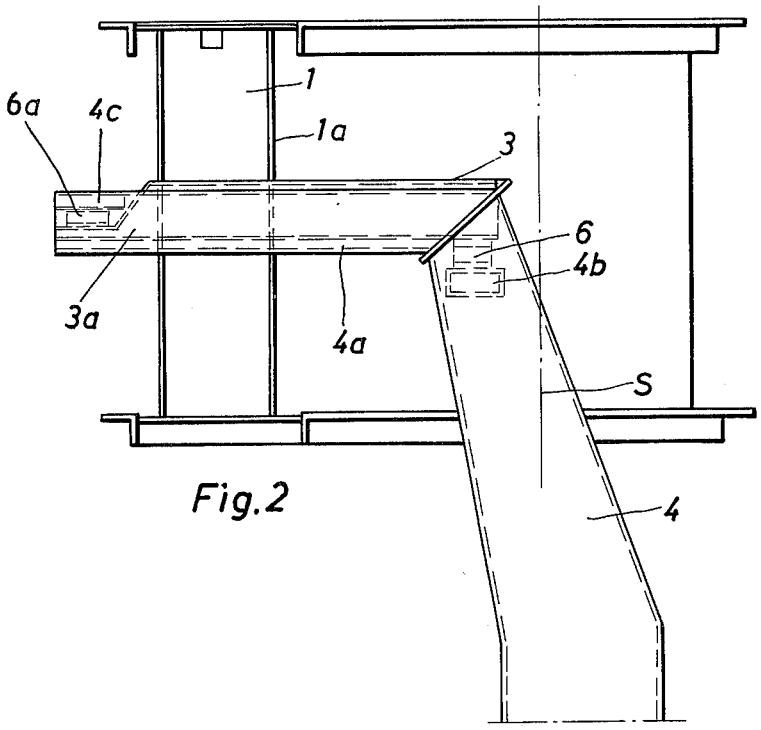
FIG. 2 is an enlarged cross sectional view taken along lines II—II of FIG. 1.
Figure 3:
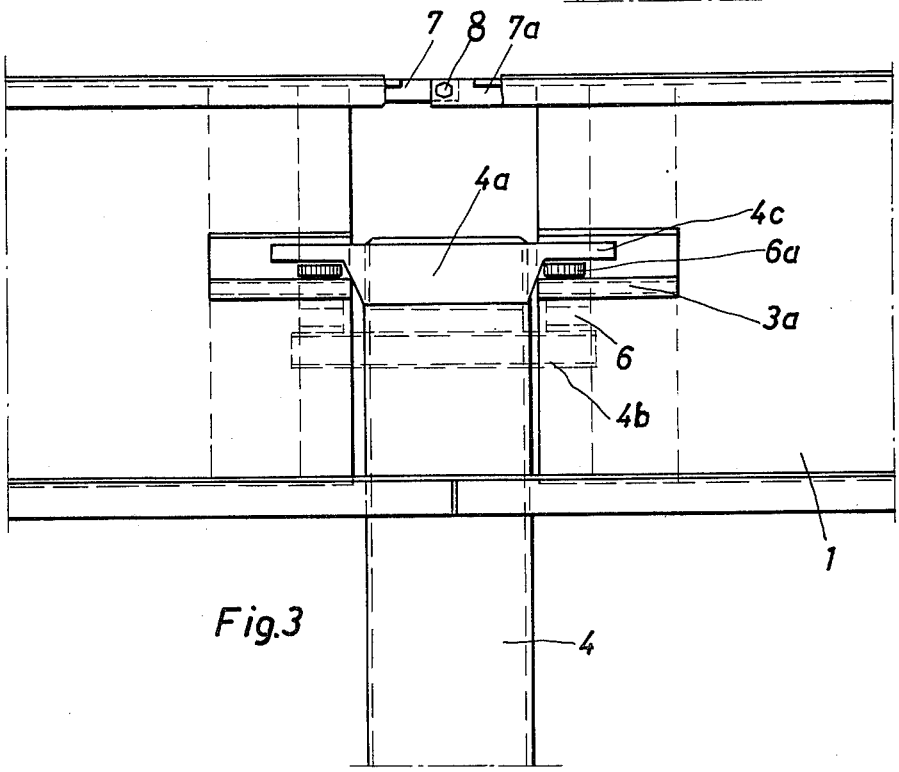
FIG. 3 is a side elevational view of the apparatus shown in FIG. 2.
Figure 4:
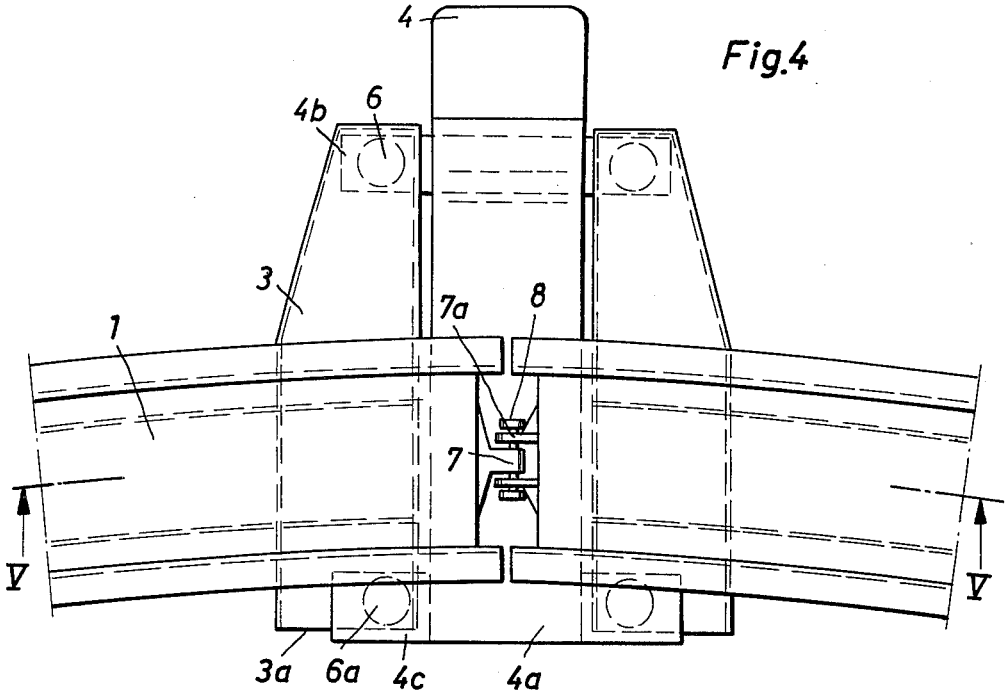
FIG. 4 is a top plan view of the apparatus shown in FIG. 2.

The ends of girder 1 are equipped, at the curvature exterior, with transverse cross-supports or consoles 3, for bracing via displacement bearings 6 onto step bearings 4*b* attached to the sides of vertical support 4. As shown in FIGS. 2–4, consoles 3 pass through girder 1 and form, on the curvature interior thereof, pivot bearings 3*a* which support via displacement bearing 6*a*, bearing plates 4*c* of crossbeam 4*a* connected to support 4.

As shown in FIG. 2, longitudinal line of gravity S of the girder is indicated by a dot-dash line and passes far outside displacement bearing 6 resting on step bearing 4*b*. Any tilting of girder 1 around bearing 6 is eliminated by tilt-displacement bearing 6*a* arranged between pivot bearing 3*a* and bearing plate 4*c*. Step bearings 4*b* are located on both sides of support 4, as is shown in FIGS. 3 and 4.

Figure 5:
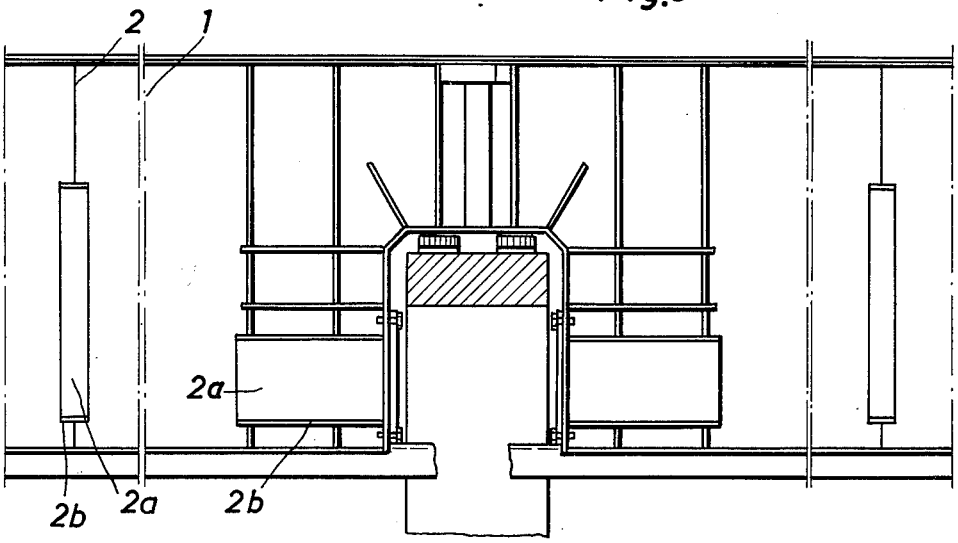
FIG. 5 is a cross sectional view taken along lines V-V of FIG. 4.
Figure 6:
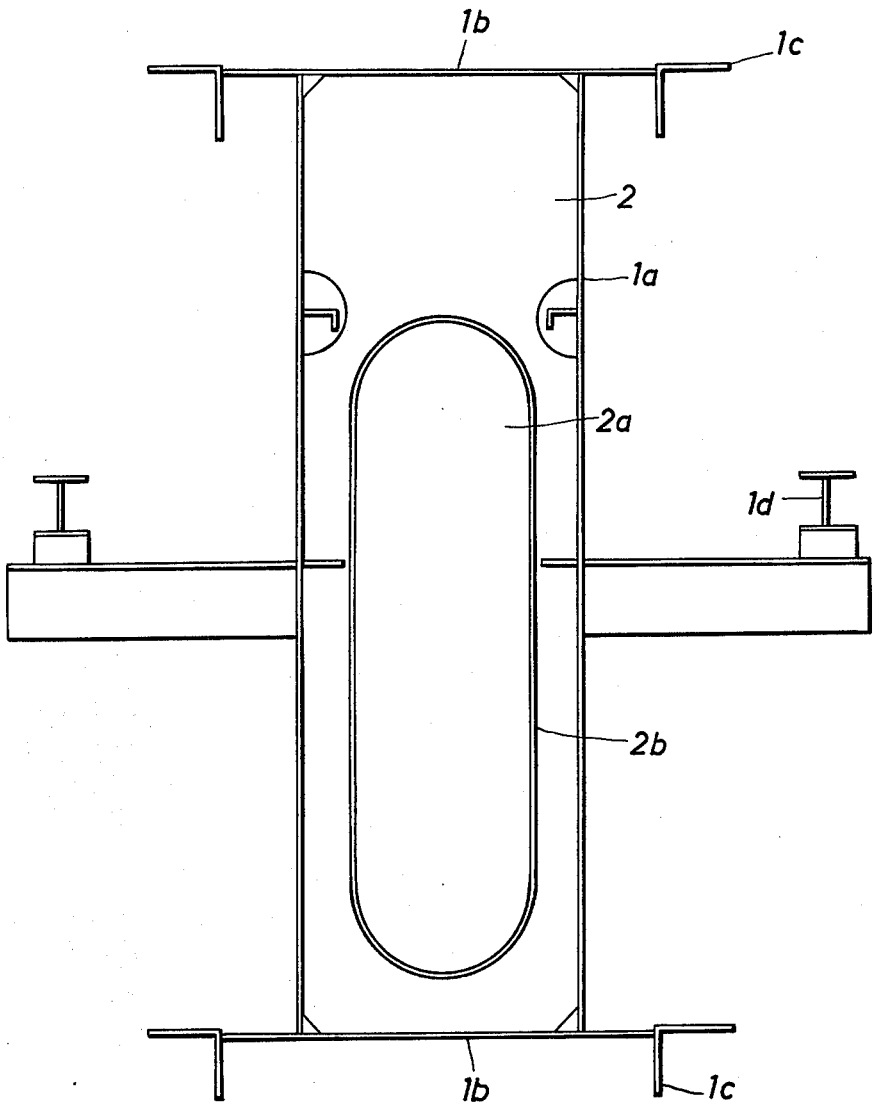
FIG. 6 is a cross sectional view of one embodiment of girder embodying aspects of the invention.

As shown in FIG. 5 and 6, transverse crossbeams 2 extend inbox-shaped girder 1 with its vertical stays 1*a* and upper and lower plates 1*b*, to which are attached angle irons 1*c*. The angle irons 1*c* form the tracks for suspended vehicles (not shown). The upright vehicles run on the I-shaped rails 1*d*. Cross braces 2 are provided with cut-out clearances 2*a*, its edges being reinforced by welded flat steel plates 2*b*. Clearances 2*a* facilitate the inspection of girder 1. At the girder ends, crossbeams 2 are arranged at shorter intervals than usual to transmit the great tilting moments onto bearings 6, and they are connected with one another by means of the flat steel plates 2*b*.

As shown in FIGS. 3 and 4, the adjacent girder ends are provided with tabs, such as 7 and 7*a*, for receiving pressure screws 8 so as to properly align the girders forming the monorail support end to end.

While the apparatus herein disclosed forms preferred embodiments of the invention, this invention is not limited to those specific forms of apparatus, and changes can be made therein without departing from the scope of the invention, which is defined in the appended claims.

I claim:

1. A support for sharply curved load bearing girders forming a portion of a track for an elevated transportation system, characterized by
   a. an elongated sharply curved girder;
   b. a vertical support at each end of said girder;
   c. said vertical supports being positioned adjacent said girder;
   d. a cross-support at each end of said girder, each said cross-support extending through the girder end and having one end thereof supported on its respective vertical support;
   e. the opposite end of said cross-support forming one side of a pivot bearing;
   f. a crossbeam connected to each said vertical support and extending across its respective girder end; and
   g. one end of each said crossbeam forming the other side of said pivot bearing.

2. The support of claim 1, further characterized by
   a. each said cross-support extending through its respective girder end at the horizontal longitudinal axis of said girder.

3. The support of claim 1, further characterized in that
   a. the vertical extent of each said cross-support is 25% or less the vertical extent of said girder.

4. The support of claim 1, further characterized in that
   a. each said pivot bearing is positioned on the outside of the curve of said girder.

5. The support of claim 1, further characterized by
   a. vertical web braces extending across said girder; and
   b. each said cross-support being connected to said vertical web braces.

6. The support of claim 5, further characterized by
   a. step bearings positioned on each said vertical support, said step bearings supporting one end of each said cross-support.

7. The support of claim 6, further characterized by
   a. displacement bearings disposed between each said step bearing and its respective cross-support.

8. The support of claim 5, further characterized by
   a. said vertical web braces having access openings therein.

9. The support of claim 8, further characterized by
   a. each said opening being defined by reinforcement plates.

10. The support of claim 1, further characterized in that a. the end of each said crossbeam adjacent said pivot bearings having bearing plates extending over said pivot bearings.

11. The support of claim 10 further characterized by a. displacement bearings positioned between each said pivot bearing and its respective bearing plate.

12. The support of claim 1, further characterized in that a. each said vertical support at each end of said girder forms the end support for successive girders forming the track of a transportation system.

13. The support of claim 12, further characterized in that a. said girder and successive girders have rails disposed thereon forming a continuous track for vehicles.

14. The support of claim 12, further characterized by a. a connecting device disposed at each end of said girder for connecting succeeding girders together, said connecting devices preventing lateral displacement of connected adjacent ends of said girders.

15. The support of claim 14, further characterized in that a. said connecting devices are integral tabs with openings therein for receiving a connecting bolt.

* * * * *